US005768880A

United States Patent [19]

Schmid

[11] Patent Number: 5,768,880

[45] Date of Patent: Jun. 23, 1998

[54] OPENING ROLLER FOR AN OPEN-END SPINNING DEVICE

[75] Inventor: Friedbert Schmid, Bad Überkingen, Germany

[73] Assignees: Fritz Stahlecker, Bad Überkingen; Hans Stahlecker, Süssen, both of Germany

[21] Appl. No.: 815,458

[22] Filed: Mar. 11, 1997

[30] Foreign Application Priority Data

Mar. 20, 1996 [DE] Germany ..... 196 109 61.2

[51] Int. Cl.[6] ..... D01H 4/00

[52] U.S. Cl. ..... 57/408; 19/115 R

[58] Field of Search ..... 19/112, 114, 115 R, 19/97, 85; 57/408, 412, 413

[56] References Cited

U.S. PATENT DOCUMENTS

| | | | |
|---|---|---|---|
| 4,044,427 | 8/1977 | Ankrom et al. | 19/97 |
| 4,144,707 | 3/1979 | Stahlecker | 57/58.91 |
| 4,163,304 | 8/1979 | Laflaquiere et al. | 19/97 |
| 4,196,496 | 4/1980 | Stauffer et al. | 19/97 |
| 4,272,865 | 6/1981 | Schmolke | 19/97 |
| 4,296,527 | 10/1981 | Eadie | 19/112 |
| 4,300,265 | 11/1981 | Heinen | 19/112 |
| 4,679,390 | 7/1987 | Stewart | 57/408 |
| 4,715,177 | 12/1987 | Stahlecker | 57/408 |
| 4,894,983 | 1/1990 | Schmid | 57/408 |

*Primary Examiner*—C. D. Crowder
*Assistant Examiner*—Tina R. Taylor
*Attorney, Agent, or Firm*—Evenson McKeown Edwards & Lenahan, PLLC

[57] ABSTRACT

An opening roller for an open-end spinning device comprises a shaft supported in a bearing housing. A base body is arranged on the shaft, on which base body an exchangeable ring with combing structure is slidably arranged . The ring with combing structure is fixed at its end faces between a flange of the base body and a flange of a detachably applied tension disc. In order to brace the tension disc against the ring with combing structure by means of a spring element, a screw is axially screwed into the shaft, which screw is provided with working surfaces for a tool for pulling the opening roller out of a holding device of the bearing housing. The working surfaces are located at the end of a through bore hole of the screw on the side facing away from the head of the screw. The tension disc has an even outer front surface, which is partly formed by a covering cap, which comprises, in extension of the through bore hole, a small bore hole for inserting the tool.

13 Claims, 2 Drawing Sheets

OPENING ROLLER FOR AN OPEN-END SPINNING DEVICE

BACKGROUND AND SUMMARY OF THE INVENTION

This application claims the priority of German patent application 196 109 61.2, filed in Germany on Mar. 20, 1996 the disclosure of which is expressly incorporated by reference herein.

The present invention relates to an opening roller for an open-end spinning device comprising a shaft supported in a bearing housing, a base body arranged on the shaft, and an exchangeable ring with combing structure slidably arranged on the base body. The ring with combing structure is fixed at its end faces between a flange of the base body and a flange of a detachable tension disc. A screw, axially screwed into the shaft, braces the tension disc against the ring with combing structure by means of a spring element, the screw being provided with working surfaces for a tool for releasing the opening roller from a holding device of the bearing housing.

In the case of an opening roller of this type (U.S. Pat. No. 4,894,983), a ring groove is provided at the outer end of the head of the screw, which ring groove serves to engage a tool with which the entire opening roller, including its bearing housing, can be released in axial direction from a corresponding holding device. As the head of the screw must contain the above mentioned ring groove for the tool in addition to a stopping surface for the spring element, the head of the screw presents unwanted retention surfaces for fly. If the screw is covered by a cap to avoid fly retention on the head of the screw, this cap would have to be removed before the opening roller could be released from its holding device, which would mean an additional step in the maintenance process.

It is an object of the present invention to avoid the above mentioned disadvantages and to create an opening roller which is less prone to fly retention and which can be easily and quickly released from its holding device.

This object has been achieved in accordance with the present invention in that the screw is provided with an axial bore hole for inserting the tool and that the tension disc has an even outer front surface.

An axial bore hole, in particular when it is advantageously in the form of a through bore hole, can be easily made, whereby the head of the screw can to a great extent be free of retention surfaces for fly. As outer working surfaces for a tool do not have to be taken into consideration anymore, practically the whole front surface of the tension disc can be entirely even and smooth, with the exception of the area of the head of the screw itself. However, this head of the screw can also be covered when a covering cap is inserted in the outer front surface of the tension disc, which covering cap forms part of the front surface and which in extension of the axial bore hole has a small bore hole for inserting the tool. In this way, the head of the screw is covered also, whereby only a small entry opening for the mandrel-like tool remains exposed.

These and further objects, features and advantages of the present invention will become more readily apparent from the following detailed description thereof when taken in conjunction with the accompanying drawings.

DETAILED DESCRIPTION OF THE DRAWINGS

Figure 1:
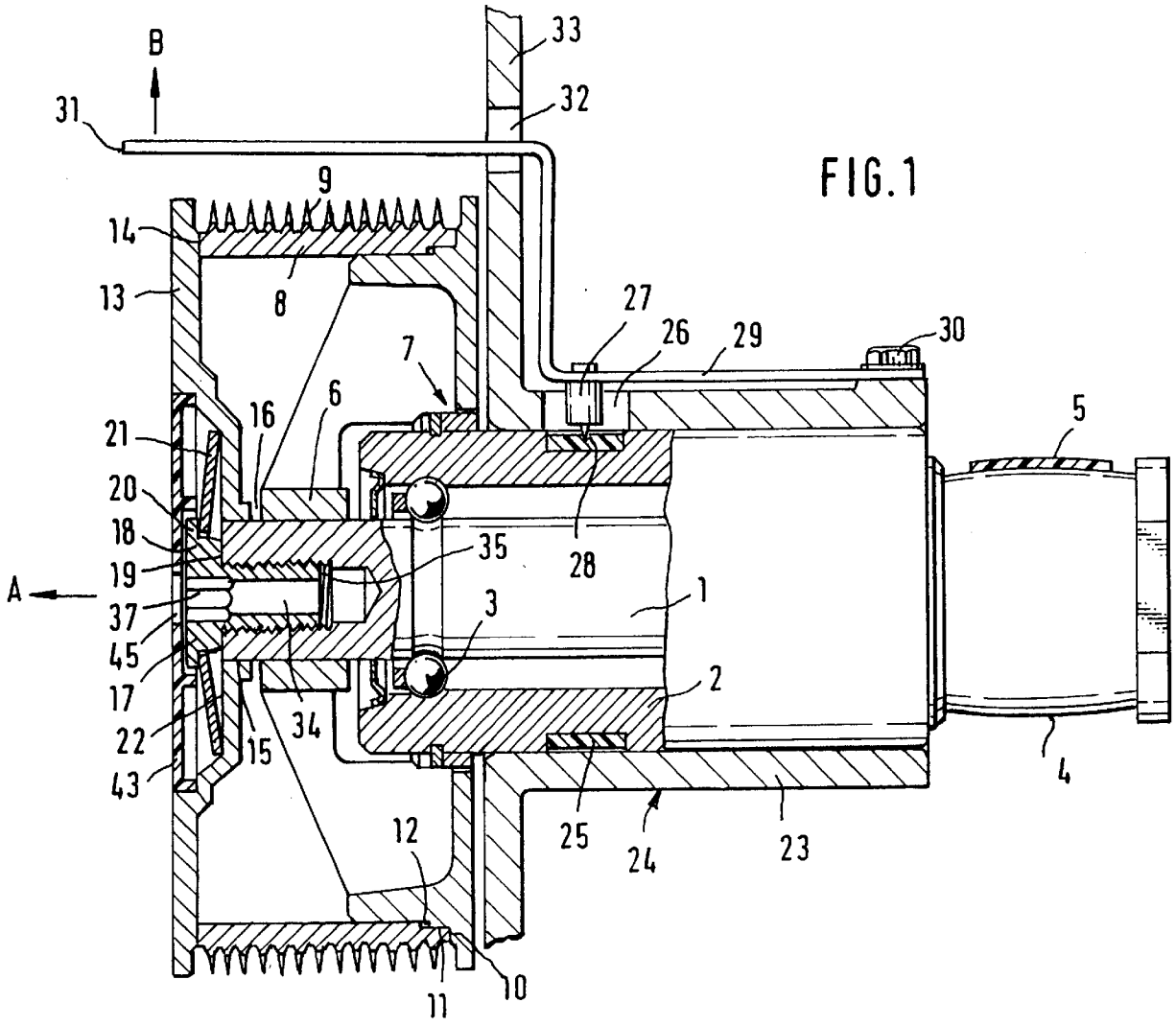
FIG. 1 is a longitudinal section through an opening roller assembly constructed according to a preferred embodiment of the present invention.

The opening roller shown comprises a shaft 1, which is supported in a bearing housing 2 by means of anti-friction bearings, of which only the bearing 3 can be seen in FIG. 1. The shaft 1 projects with its two ends out over the bearing housing 2. The right end of the shaft 1 in FIG. 1 is provided with a drive wharves 4, by means of which the opening roller can be driven by a drive belt 5.

A base body 6 is placed on the other end of the shaft 1 by means of a press fit, namely in such a way that the shaft 1 still projects out over the base body 6 on the side facing away from the bearing housing 2.

The base body 6 overlaps the bearing housing 2 and forms, together with the outer side of the bearing housing 2, a sealing gap 7.

On the outer circumference of the base body 6, which comprises a cylindrical outer surface, a ring 8 with combing structure is placed with a light sliding fit. The ring 8 is provided with combing structure 9 of teeth or needles. The combing structure 9 is preferably ground into the ring body, so that the combing structure 9 forms one piece with the ring 8.

The ring 8 is supported with an end face against a flange 10 of the base body 6. In this area the outer circumference of the base body 6 is provided with a light collar 11, to which a corresponding recess 12 of the ring 8 with combing structure is arranged. By means of the collar 11 and the recess 12 it is ensured that the ring 8 cannot be slid laterally reversed onto the base body 6.

The ring 8 with combing structure is fixed against the flange 10 of the base body 6 by means of a tension disc 13 which is disposed with a flange 14 at an opposite end face of the ring 8 with combing structure. The tension disc 13 is provided with a central bore hole 15, by means of which the tension disc 13 is placed upon the shaft 1. The tension disc 13 and the ring 8 with combing structure are of such dimensions that a gap 16 remains between the base body 6 and the tension disc 13.

The tension disc 13 is fixed against the ring 8 with combing structure in axial direction of the shaft 1 by means of a screw 17. The screw 17 is screwed centrically into the shaft 1. The screw 17 comprises a head 18, which is disposed in the screwed-in position with a stopping surface 19 at the front end face of the shaft 1.

At an axial distance from the stopping surface 19, a collar 20 is applied to the head 18 of the screw 17, which collar 20 serves to engage a spring element 21 in the form of a disc spring, whose outer edge is supported in a corresponding recess 22 on the tension disc 13. The distance between the stopping surface 19 and the collar 20 and the distance between the recess 22 and the collar 20 is such that the disc spring 21, in the operational position in which the head 18 of the screw 17 is disposed with the stopping surface 19 on the front surface of the shaft 1, is not disposed "en bloc" (so that the disc spring 21 can still be elastically compressed).

For maintenance purposes it should be ensured that the opening roller, including the bearing housing 2 can be relatively easily disassembled in arrow direction A towards the service side whenever required. In such a case the drive belt 5 is, of course, raised by certain means (not shown) from the drive wharve 4, so that the opening roller comes to a standstill.

In order that this disassembly is possible, the bearing housing 2 is supported with a relatively wide sliding fit in a cylindrical extension 23 of a holding device 24 and affixed by means of an additional axial safety device, as is for example described in U.S. Pat. 4,144,707. For this purpose the bearing housing 2 is provided with a ring groove, in which a flexible insert 25 is inserted, which has approximately the same outer diameter as the bearing housing 2. In the cylindrical extension 23, in the area of the flexible insert 25 of the bearing housing 2, a recess 26 is provided, into which a thrust piece 27, which comprises a tip 28, projects. This thrust piece 27, whose tip 28 penetrates the flexible insert 25, takes over the function of the axial safety device and the anti-rotation device. The thrust piece 27 projecting into the recess 26 is supported by a leaf spring 29, which is affixed at the furthest possible distance with the aid of a screw 30 on a flange of the bearing housing 2. This leaf spring 29 is disposed parallel to the shaft 1 of the opening roller, so that additional space requirement is low.

The leaf spring 29 is extended past the thrust piece 27 towards the service side in such a way that its free end 31 projects into the area of the ring 8 with combing structure. The leaf spring 29 has for this purpose a Z-shaped form, bent at right angles, and is guided through a bore hole 32 of a wall part 33 of the opening roller housing. The free end 31 is thus disposed in an area which must be exposed in order to check the opening roller and is thus directly accessible. The free end 31 serves as an operating lever, which when swivelled in the direction of the arrow B releases the thrust piece 27 from the flexible insert 25. The opening roller, including the bearing housing 2, can be easily withdrawn in arrow direction A from the holding device 24.

Figure 2:
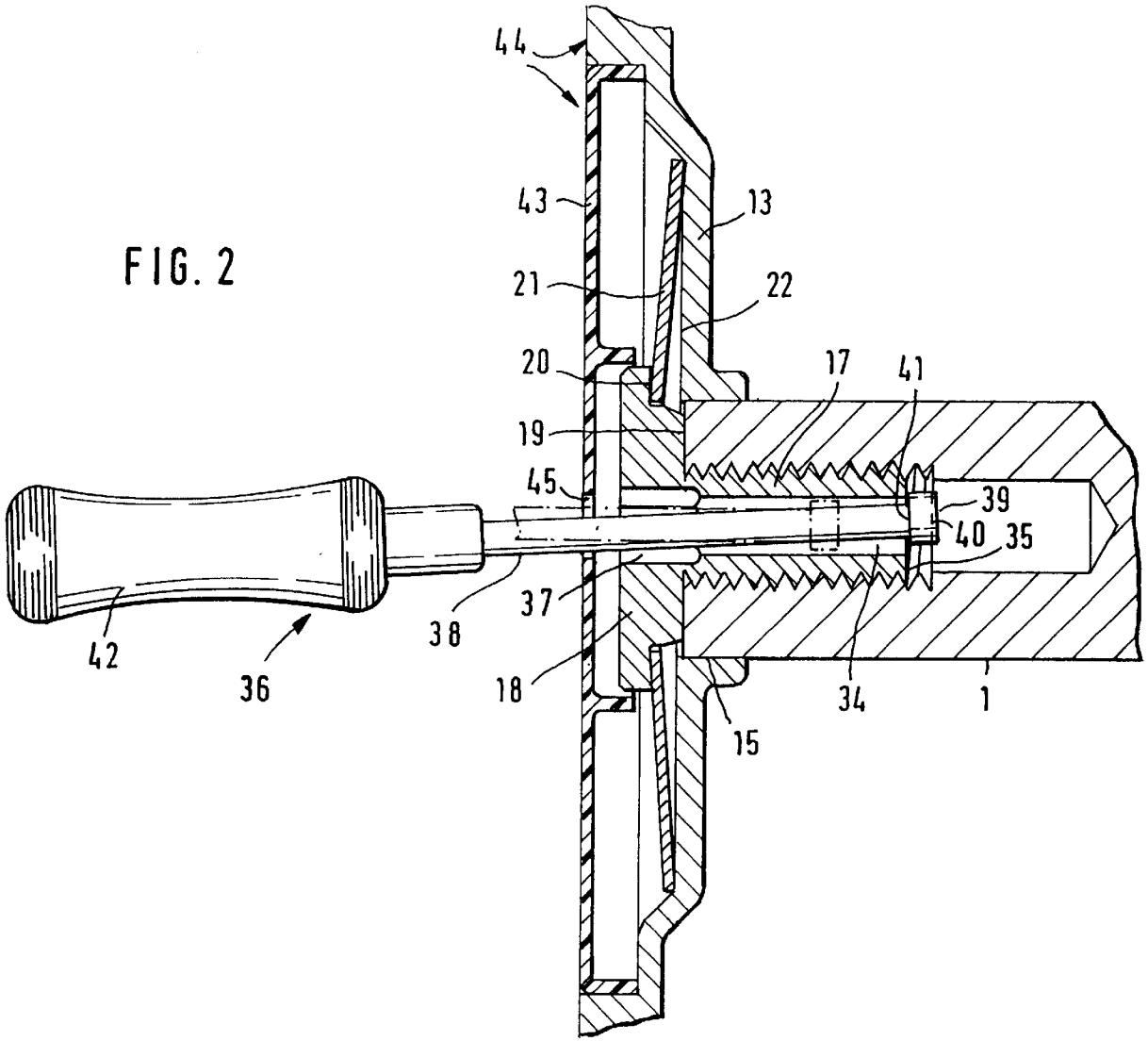
FIG. 2 is a greatly enlarged section of FIG. 1 in the area of the screw, showing the tool and the axial bore hole into which the tool for releasing the opening roller from its holding device is inserted.

In order to facilitate the engaging of the opening roller, the screw 17 is provided with working surfaces 35 for a tool 36, see in particular FIG. 2. The screw 17, which is screwed into a threaded bore hole of the shaft 1, is provided with an axial bore hole 34 in the form of a through bore hole. The through bore hole has the same diameter all the way through, and the end of the screw 17 located in the threaded bore hole of the shaft 1 forms the working surfaces 35 for the tool 36. In addition, a hexagon socket 37 is applied to the head 18 of the screw 17, which enables the screw 17 to be turned.

The tool 36, provided with an operating handle 42, has a mandrel 38, whose end 39 comprises an area 40 with an enlarged diameter. The mandrel 38 is insertable into the axial bore hole, whereby the diameter of the area 40 is such that it is somewhat smaller than the diameter of the axial bore hole 34. The position of the tool 36 when being inserted into the axial bore hole 34 is denoted in FIG. 2 by dot-dash lines.

As soon as the area 40 with an enlarged diameter is guided over the inner end of the screw 17, the tool 36, shown in FIG. 2 by a continuous line, can be slightly tilted. A step 41 of the area 40 thus comes to rest on the above mentioned working surfaces 35 of the screw 17. The opening roller can thus be easily removed from its holding device 24 in arrow direction A.

A covering cap 43 made of plastic is clipped onto the tension disc 13 in the area of the screw 17, which cap 43 then forms part of the tension disc 13. The tension disc 13 thus obtains an even smooth outer front surface 44, on which practically no fly can accumulate . In order only to expose the axial bore hole 34, the cap 43 is provided with a small centrical bore hole 45. The cap 43 does not therefore need to be released from the tension disc 13 when the opening roller, including the bearing housing 2, is withdrawn from the holding device 24.

Reassembly in the holding device 24 takes place in the reverse direction, that is in the opposite direction to direction A. The tool 36 is not required for this process.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An opening roller for an open-end spinning device comprising:

a shaft supported in a bearing housing, a base body arranged on the shaft, an exchangeable ring with combing structure placed on the base body, which ring with combing structure is fixed with its end faces between a flange of the base body and a flange of a releasably applied tension disc, and a screw screwed axially into the shaft which braces the tension disc by means of a spring element against the ring with combing structure, which screw is provided with working surfaces for a tool for withdrawing the opening roller ring from a holding device of the bearing housing, wherein the screw is provided with an axial bore hole for inserting a tool and wherein the tension disc has an even smooth outer front surface.

2. An opening roller according to claim 1, wherein the axial bore hole is in the form of a through bore hole.

3. An opening roller according to claim 2, wherein a covering is applied at the outer front surface of the tension disc, which cap in extension of the axial bore hole comprises a small bore hole for inserting the tool.

4. An opening roller according to claim 1, wherein a covering cap is applied at the outer front surface of the tension disc, which cap in extension of the axial bore hole comprises a small bore hole for inserting the tool.

5. An opening roller assembly for an open-end spinning machine comprising:

a bearing housing exchangeably supportable in a holding device, a roller shaft supportable in the bearing housing, a base body on the roller shaft, an exchangeable combing ring having one end engageable with a flange at the base body, a tension disk engageable with an opposite end of said combing ring, a spring element, and a threaded screw member adapted to threadably engage a threaded bore of said base body to releasably clamp the spring element against the tension disc and thereby clamp the combing ring between the tension disc and the flange of the base body, said screw having an axial bore and a radially extending working surface extending from the axial bore, said working surface being adapted to be engaged by a tool for selectively axially and unitarily removing the screw, combing ring, base body and bearing housing from the holding device to thereby accommodate exchange of the combing ring.

6. An opening roller assembly according to claim 5, comprising a tool having:

a tool collar at its end which in use engages behind the working surface.

7. An opening roller assembly according to claim 6, wherein the axial bore hole is in the form of a through bore hole.

8. An opening roller assembly according to claim 6, wherein said axial bore and said tool are configured so that the tool can be inserted axially in said axial bore, and then tilted to position the tool collar behind the axial abutment surface of the screw.

9. An opening roller assembly according to claim 6, wherein said axial bore includes an internal polygon socket enabling the screw to be turned.

10. An opening roller assembly according to claim 9, wherein the polygon socket is a hexagon socket located adjacent an end of the axial bore opposite the working surface.

11. An opening roller assembly according to claim 5, wherein the axial bore hole is in the form of a through bore hole.

12. An opening roller assembly according to claim 5, comprising a covering cap which in use covers the screw except for a small axial bore hole aligned with the axial bore of the screw for accommodating insertion of said tool.

13. An opening roller assembly according to claim 12, wherein said tension disc and covering cap together form a smooth even surface facing axially away from the combing ring, which smooth even surface avoids accumulation of fly thereon.

* * * * *